US006196833B1

(12) United States Patent
Ho

(10) Patent No.: US 6,196,833 B1
(45) Date of Patent: Mar. 6, 2001

(54) ACTIVE SAFETY SWITCH FOR GAS BURNER

(76) Inventor: Chi-Sheng Ho, No. 65, Cheng-Tien Rd., Tu-Cheng City, Taipei Hsien (TW)

( * ) Notice: Subject to any disclaimer, the term of this patent is extended or adjusted under 35 U.S.C. 154(b) by 0 days.

(21) Appl. No.: 09/553,059

(22) Filed: Apr. 20, 2000

(51) Int. Cl.[7] ..... F23D 14/28
(52) U.S. Cl. ..... 431/153; 431/255; 431/344
(58) Field of Search ..... 431/155, 255, 431/277, 344, 276, 345, 266; 126/401, 407, 405, 413, 414

(56) References Cited

U.S. PATENT DOCUMENTS

| | | | | |
|---|---|---|---|---|
| 3,155,140 | * | 11/1964 | Wilson | 431/153 |
| 5,496,169 | * | 3/1996 | Chen | 431/255 |
| 6,050,810 | * | 4/2000 | Huang | 431/255 |
| 6,059,563 | * | 5/2000 | Hsu | 431/255 |

* cited by examiner

*Primary Examiner*—James C. Yeung
(74) *Attorney, Agent, or Firm*—Bacon & Thomas

(57) ABSTRACT

An additional active safety switch for gas burner with active restoring capability is provided to actively prevent the ignition trigger of the gas burner from being pulled arbitrarily or from keeping enabled constantly for enhancement of security.

1 Claim, 6 Drawing Sheets

ACTIVE SAFETY SWITCH FOR GAS BURNER

BACKGROUND OF THE INVENTION

This invention relates generally to a safety switch for a gas burner, and more particularly, it relates to an active safety switch for a gas burner that can restore actively to prevent the ignition trigger from being pulled arbitrarily or from keeping enabled constantly for enhancement of security.

Usually, a gas burner will continuously burns as long as it is kindled and switch is kept open. For snuffing the gas burner out, a user has to take an action to close the gas switch, or in the case where the gas switch is interacted with a trigger, the flame is extinguished automatically as soon as the trigger is released. However, under either case mentioned, the gas burner lacks an active safety switch for the prevention of accidental ignition or any unnecessary conflagration.

In using an existing gas burner, which is generally provided with an auxiliary closing mechanism, a user should not forget to have the auxiliary closing mechanism effectuated to disable the trigger and ensure safety when he puts out the gas burner, or a disaster beyond compensation might be incurred if the trigger is pulled by a child or somebody else who is ignorant to danger of the gas burner.

In view of abovesaid imperfections, after years of constant effort in research, the inventor of this invention has consequently developed and proposed an improved mechanism pertaining to the subject matter for prevention of unnecessary accidents in using a gas burner.

SUMMARY OF THE INVENTION

The primary object of this invention is to provide an active safety switch for gas burner that can restore actively to prevent the ignition trigger from being pulled arbitrarily or from keeping enabled constantly to ensure safety in using a gas burner.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
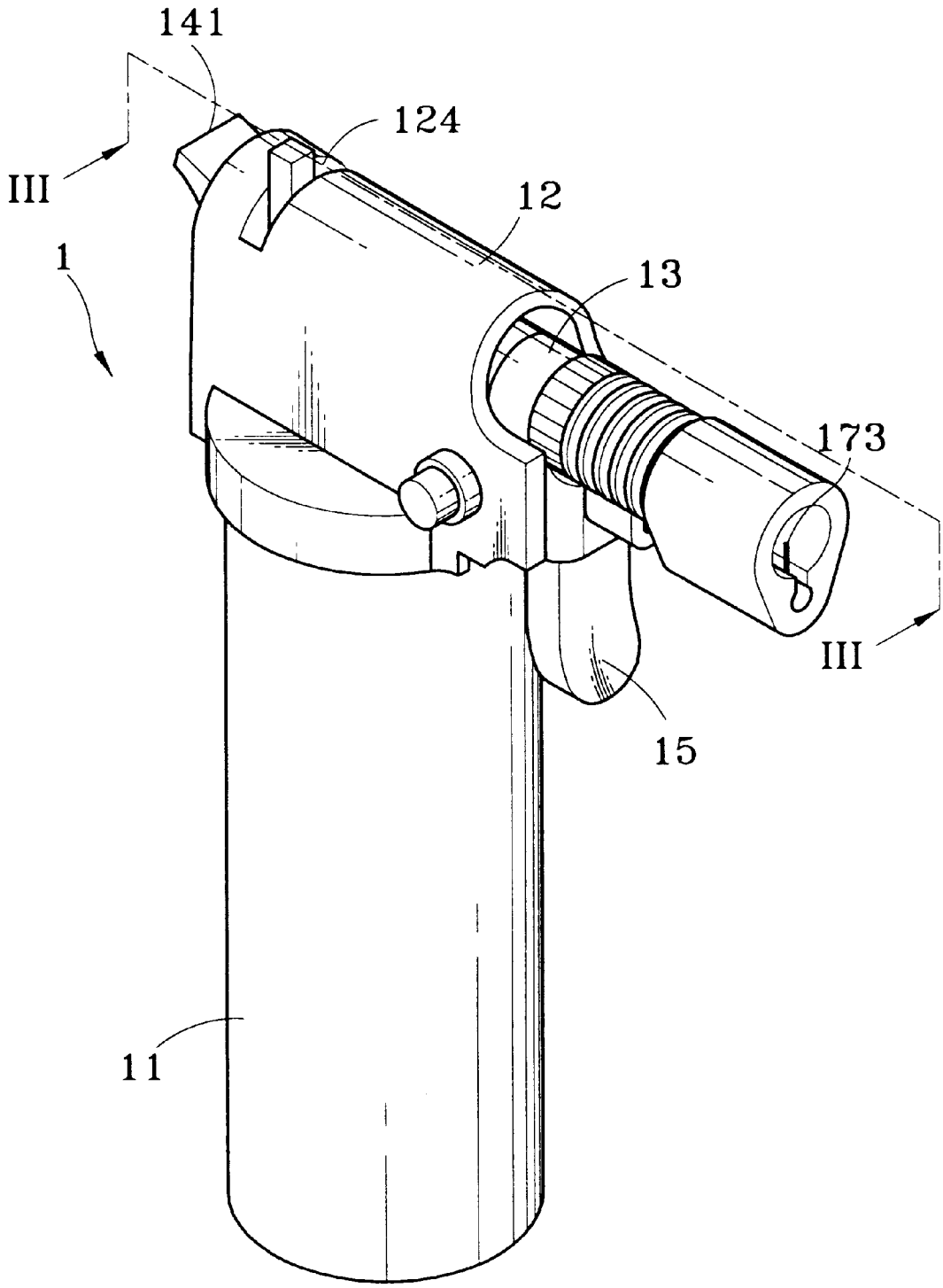
FIG. 1 is a three-dimensional schematic view of this invention.
Figure 2:
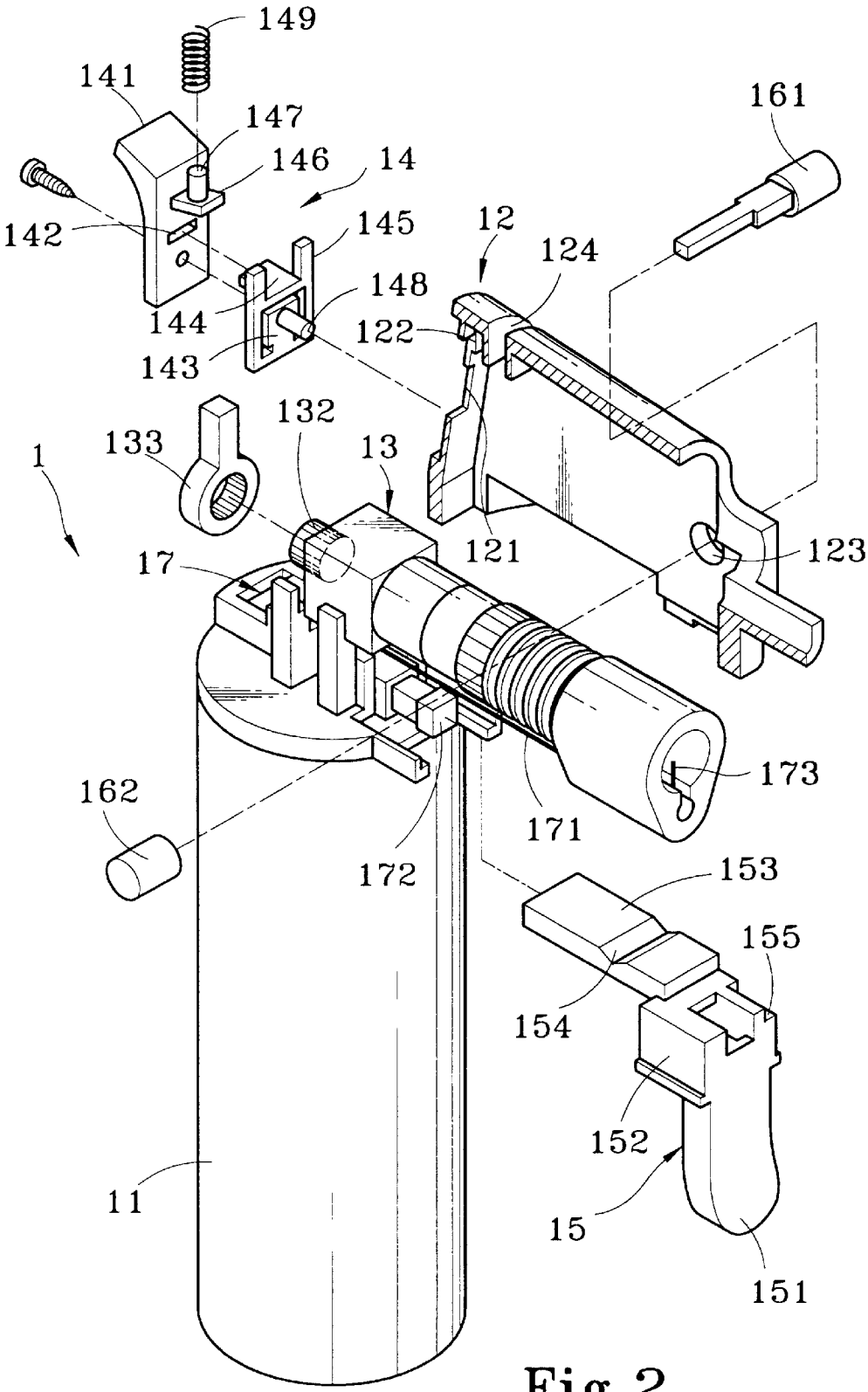
FIG. 2 is a three-dimensional exploded view of this invention.
Figure 3:
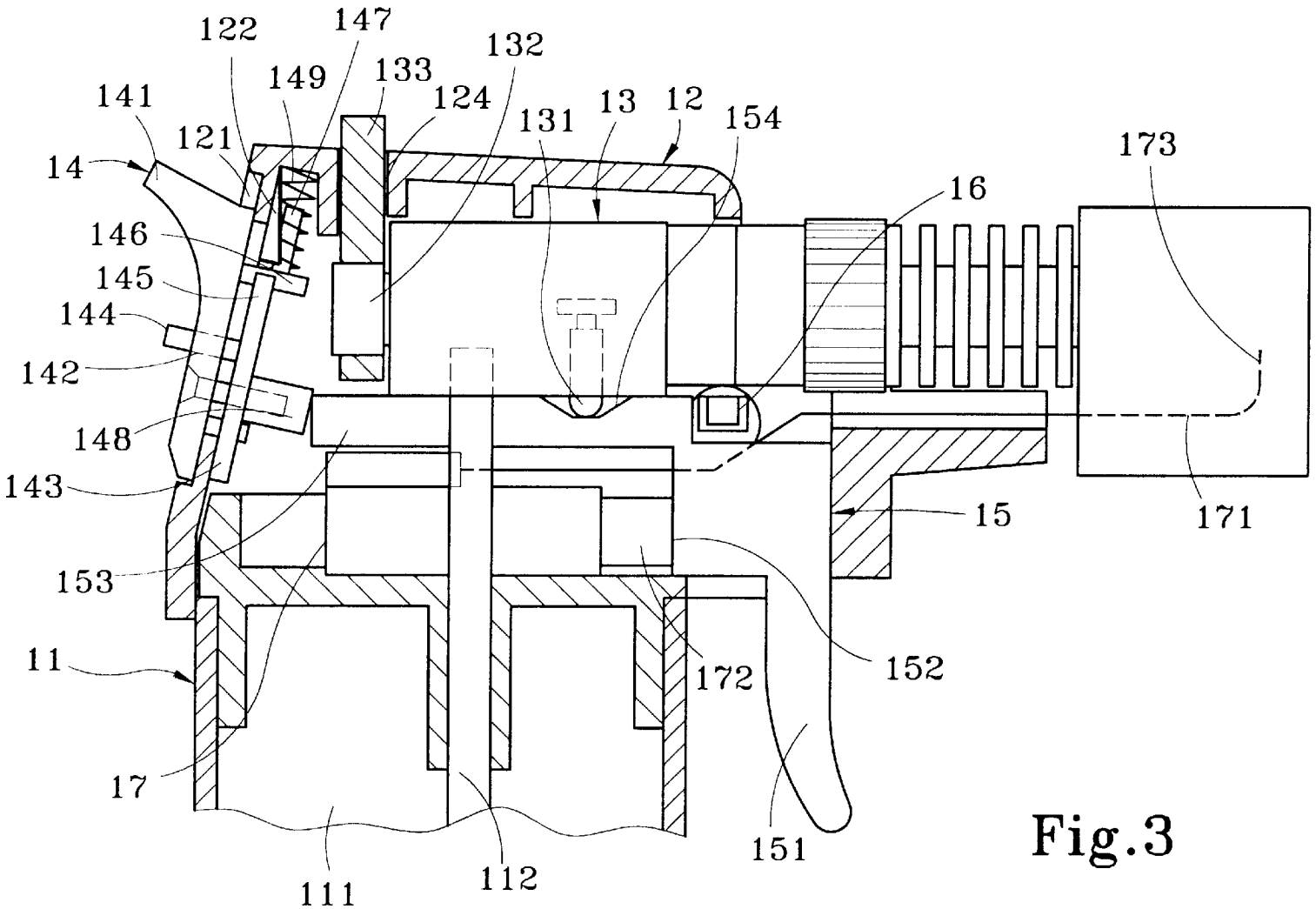
FIG. 3 is a cutaway sectional view taken along line III—III in FIG. 1.

As shown in FIG. 1 through FIG. 3, a gas burner 1 mainly comprises a handgrip 11, a top strap 12 on the handgrip 11, a valve 13 underneath the top strap 12, a safety switch 14 at rear end of the top strap 12, a positioning pin 16 penetratingly anchored in the top strap 12, a trigger 15 disposed at a front lower end of the top strap 12, and a piezoelectric element 17 located between the valve 13 and the handgrip 11.

A gas tank 111 having a gas inlet pipe 112 is placed in the handgrip 11.

A switch slide channel 121 formed at one end of the top strap 12 is provided with a protrusion block 122 situated at inner upper edge of the switch slide channel 121, and a positioning hole 123 is perforated at both lateral faces of the stop strap 12, and further, an adjustment slot 124 is reserved at rear end of the top strap 12.

The valve 13 is used to close, open, and adjust the gas flow, wherein a propping rod 131 for opening or closing gas flow is arranged at a lower end of the valve 13; an adjustment button 132 is disposed at tail end of the valve 13; and, the adjustment button 132 is sleeve-jointed with an adjustment knob 133 for adjusting flame of the gas burner 1.

The safety switch 14 disposed in the switch slide channel 121 of the top strap 12 comprises a driving block 141 and a pressing block 143 secured to the driving block 141, wherein a protrusion rod 144 on the pressing block 143 penetrates through and slightly projects over a through hole 142 of the driving block 141; an extension arm 146 having a protrusion rod 147 protrusively situated at its one end face and sleeve-jointed with a resilient body 149 is disposed at an end face of the driving block 141; a stop portion 145 is extended along both lateral faces of the pressing block 143 to seemingly prop the protrusion block 122 of the top strap 12; and, a stop block 148 is protrusively arranged on a lateral face of the pressing block 143.

Moreover, the lower end of the trigger 15 is a pressing portion 151, wherein a positioning groove 155 is formed at a lateral face of top edge of the pressing portion 151 and the other lateral face is a prop-and-tug portion 152; the top edge of the prop-and-tug portion 152 is extended to form an extension piece 153 whose tail end seemingly props the stop block 148 of the safety switch 14; and, a wedged groove 154 is formed in top face of the extension piece 153.

The positioning pin 16 is penetratingly disposed in the positioning hole 123 of the top strap 12 and is transversely laid on the pressing portion 151 of the trigger 15, and besides, a first and a second pressing head 161, 162 are placed at two ends of the positioning pin 16 respectively.

The piezoelectric element 17 used for creating sparks is a switch with an extended ignition line 171, and a start portion 172 of the piezoelectric element 17 is in contact with the prop-and-tug portion 152 of the trigger 15.

For keeping the gas burner 1 under flame-spouting state, a user is supposed to poke the positioning pin 16 to another side, and at this moment, the first pressing head 161 at one end of the positioning pin 16 is inserted in the positioning groove 155 for positioning the trigger 15 to allow continuous supply of the gas. When the second pressing head 162 is pressed, the first pressing head 161 will detach from the positioning groove 155 of the trigger 15 to shut down the gas supply.

Figure 4A:
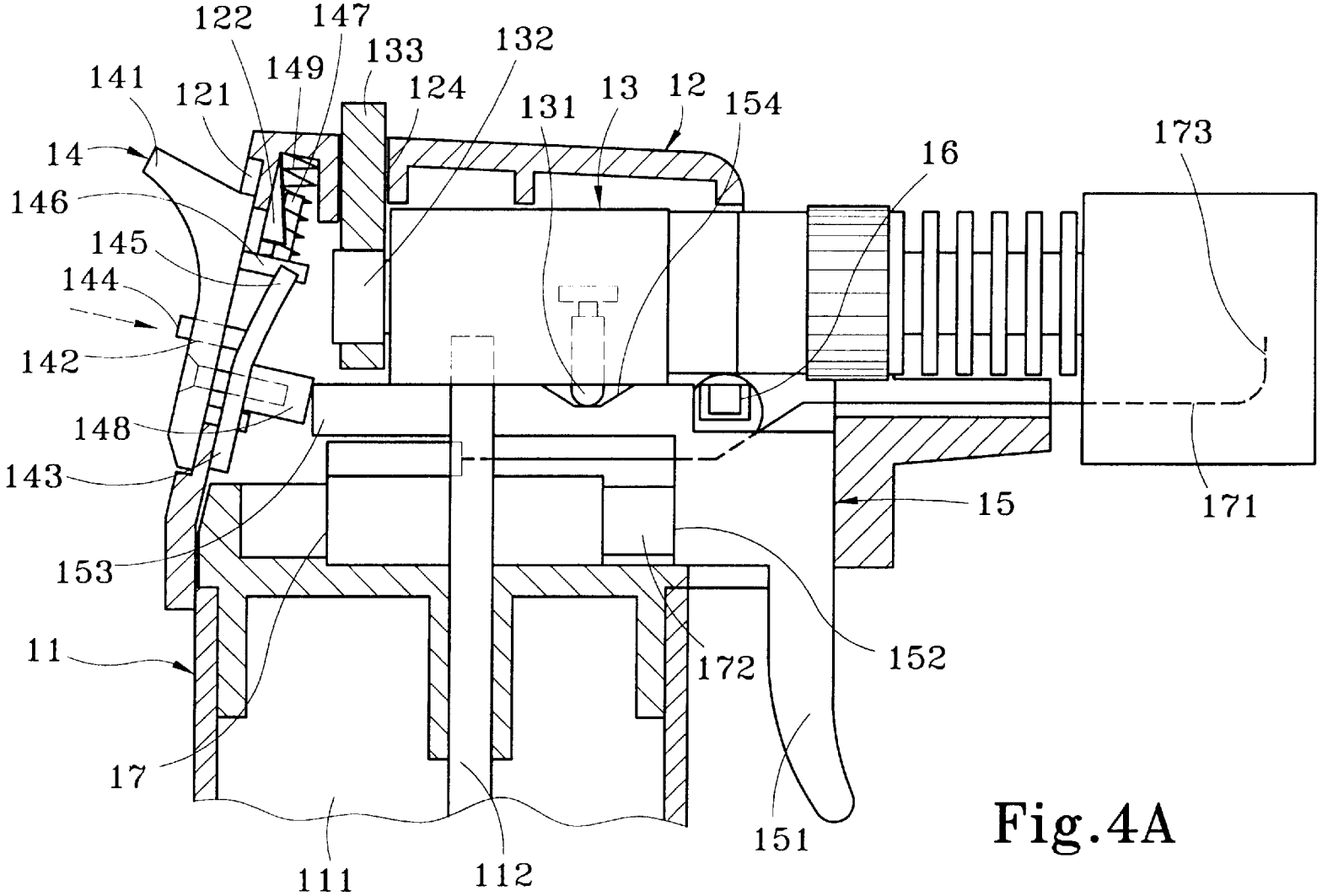
FIG. 4A is an action diagram of an active safety switch of this invention.
Figure 4B:
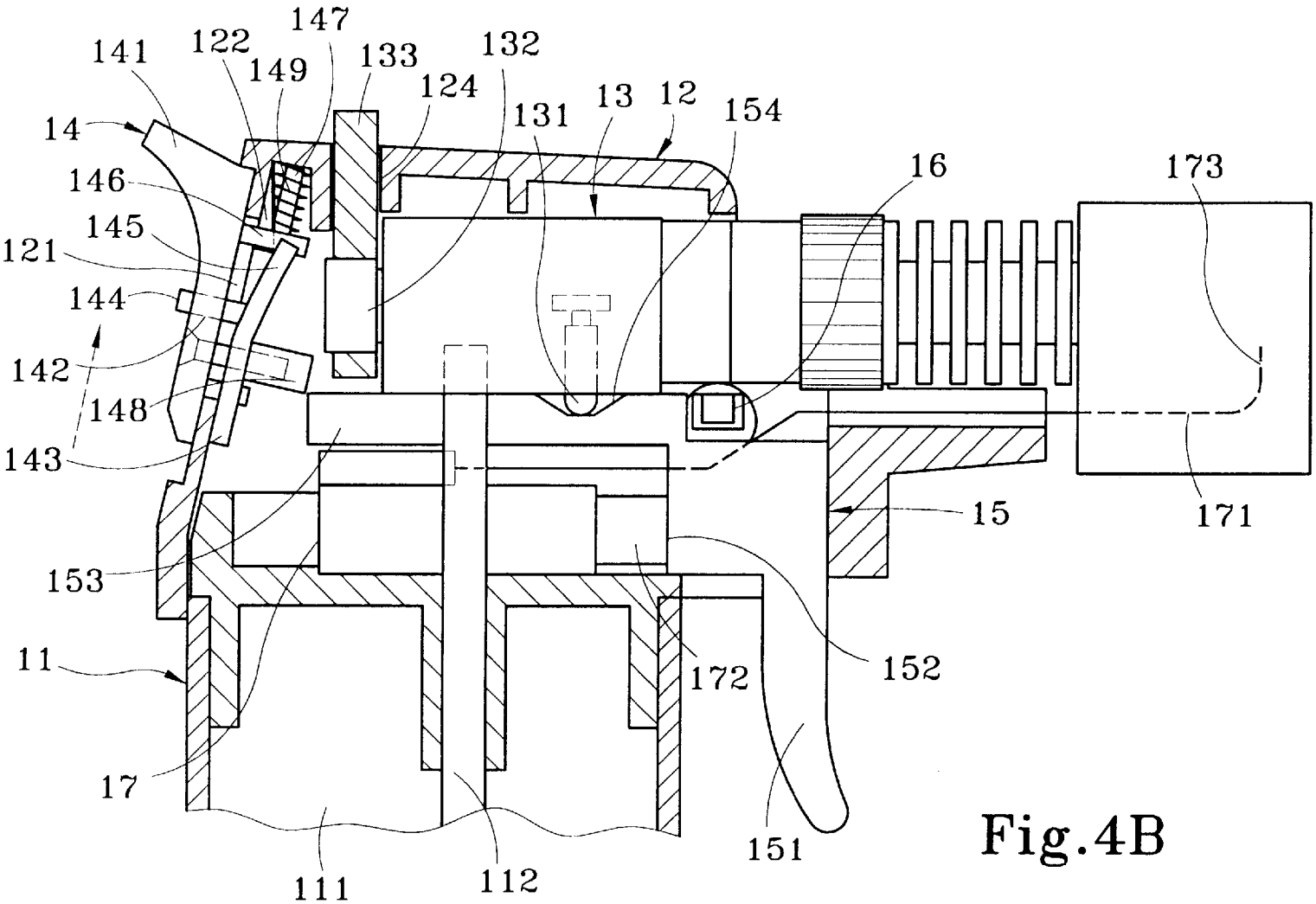
FIG. 4B is another action diagram of the active safety switch of this invention.
Figure 4C:
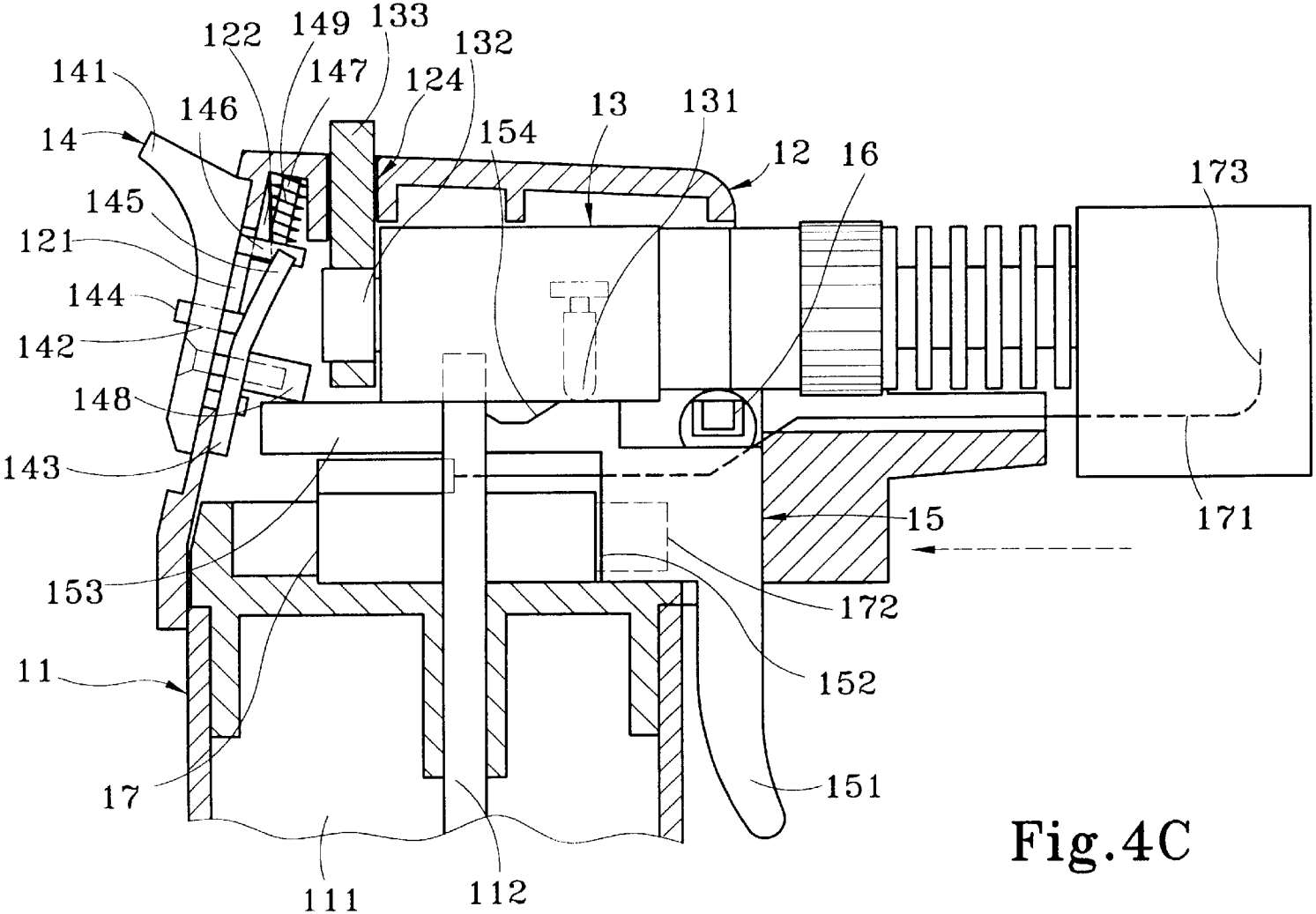
FIG. 4C is yet another action diagram of the active safety switch of this invention.

Referring to FIG. 4A through FIG. 4C, when the protrusion rod 144 of the safety switch 14 is pressed, the stop portion 145 which normally props the protrusion block 122 of the top strap 12 will be separated to push the driving block 141 of the safety switch 14 upwards. At this moment, the trigger 15 which normally props the stop block 148 of the pressing block 143 will move sideward, and the prop-and-tug portion 152 is supposed to push the piezoelectric element 17 to start and create sparks at a sparking end 173 of the ignition line 171. Meanwhile, the propping rod 131 of the valve 13 entrapped in the wedged groove 154 of the extension piece 153 is to be propped up to release the gas in the gas tank 111 via the gas inlet pipe 112 for being kindled by the created sparks.

In short, as a safety switch is available, the trigger of the gas burner cannot be pulled arbitrarily, and because it can be restored actively, any accidental pull of the trigger is prevented. Besides, a positioning pin of this invention is controllable for continuous supply of the gas without needing pulling the trigger continuously.

Although, this invention has been described in terms of preferred embodiments, it is apparent that numerous variations and modifications may be made without departing from the true spirit and scope thereof, as set forth in the following claims.

What is claimed is:

1. An active safety switch for a gas burner, comprising:

a hand grip;

a top strap connected to a top edge of said hand grip;

a safety switch connected to a rear end of said top strap;

a trigger connected to said hand grip, said trigger being located at a front lower end of said top strap, said trigger being adapted to open and close a valve located underneath said top strap;

a piezoelectric element connected to said hand grip, said piezoelectric element being located between said valve and said hand grip;

said top strap comprising a switch slide channel formed at one end thereof, said switch slide channel including a protrusion block located at an inner upper edge thereof;

said safety switch being located in said switch slide channel of said top strap and said top strap further comprising a driving block and a pressing block secured to said driving block, with the proviso that a protrusion rod is connected to said pressing block wherein said protrusion rod penetrates through and projects over a through hole of said driving block;

said driving block comprising an end face which has an extension arm extending therefrom wherein said extension arm includes an end face with a protrusion rod protruding therefrom, said protrusion rod of said extension arm being sleeve-jointed with a resilient body;

said pressing block comprising two lateral faces wherein a stop portion extends along both of said lateral faces to prop said protrusion block of said top strap and a stop block protrudes from one of said lateral faces of said pressing block;

a lower end of said trigger comprises a pressing portion wherein a top edge of said pressing portion includes a first lateral face with a positioning groove formed therein and a second lateral face with a prop-and-tug portion formed thereon, said prop-and-tug portion including a top edge from which an extension piece extends to engage said stop block of said pressing block.

* * * * *